US008869578B2

(12) United States Patent
Fleischer et al.

(10) Patent No.: US 8,869,578 B2
(45) **Date of Patent: *Oct. 28, 2014**

(54) AUTOMATIC DOMER POSITIONING IN A BODYMAKER

(71) Applicant: Stolle Machinery Company, LLC, Centennial, CO (US)

(72) Inventors: Karl Scott Fleischer, Denver, CO (US); Tracy Jay Fowler, Lakewood, CO (US)

(73) Assignee: Stolle Machinery Company, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/219,266

(22) Filed: Mar. 19, 2014

(65) Prior Publication Data

US 2014/0196513 A1 Jul. 17, 2014

Related U.S. Application Data

(63) Continuation of application No. 13/118,895, filed on May 31, 2011, now Pat. No. 8,713,980.

(51) Int. Cl.

| | |
|---|---|
| ***B21C 51/00*** | (2006.01) |
| ***B21D 22/28*** | (2006.01) |
| ***B21D 51/26*** | (2006.01) |
| ***B21D 43/00*** | (2006.01) |

(52) U.S. Cl.

CPC ..... *B21D 43/003* (2013.01); *B21D 22/283* (2013.01); *B21D 51/26* (2013.01)

USPC ..... 72/20.1; 72/349; 72/446

(58) Field of Classification Search

CPC ..... B21D 22/21; B21D 22/28; B21D 22/30; B21D 51/26

USPC ..... 72/14.8, 14.9, 20.1, 20.2, 21.1, 348, 72/349, 441, 442, 446–448

See application file for complete search history.

(56) References Cited

U.S. PATENT DOCUMENTS

| | | | | |
|---|---|---|---|---|
| 3,771,345 | A | 11/1973 | Paramonoff | |
| 5,272,902 | A | 12/1993 | Kobak | |
| 7,124,613 | B1 | 10/2006 | McClung | |
| 2006/0225479 | A1 * | 10/2006 | Zauhar | 72/348 |

* cited by examiner

*Primary Examiner* — Debra Sullivan

(74) *Attorney, Agent, or Firm* — Eckert Seamans Cherin & Mellott, LLC; David C. Jenkins

(57) ABSTRACT

In a can forming machine a system that determines the position of a reciprocating ram and allows for the domer to be repositioned automatically is provided. The system includes a punch position sensor assembly, a control system, and a domer positioning assembly. The punch position sensor assembly is positioned about the ram, preferably at the domer side of the last die. At this location, the punch position sensor assembly can determine the position of the ram as it enters the die pack during the return stroke. The control system receives data from the punch position sensor assembly and, if the ram is not substantially, concentrically aligned with the die pack on the return stroke, sends a signal to the domer positioning assembly to reposition the domer. This process may be repeated until the ram travels along a path substantially aligned with the die pack on the return stroke.

24 Claims, 7 Drawing Sheets

AUTOMATIC DOMER POSITIONING IN A BODYMAKER

CROSS REFERENCE TO RELATED APPLICATION

This application is a continuation application of and claims priority to U.S. patent application Ser. No. 13/118,895, filed May 31, 2011, entitled, AUTOMATIC DOMER POSITIONING IN A BODYMAKER.

BACKGROUND OF THE INVENTION

1. Field of the Invention

The disclosed concept relates generally to a system structured to position a domer assembly so that a reciprocating ram is substantially concentrically aligned with a die pack during the return stroke of a ram and, more specifically, to a positioning system structured to detect the position of the ram during the reciprocal motion and to move the domer assembly dynamically.

2. Background Information

Generally, an aluminum can begins as a sheet of aluminum from which a circular blank is cut. The blank is formed into a "cup" having a bottom and a depending sidewall. The cup is fed into a bodymaker which passes the cup through additional circular dies that thin and elongated the cup. That is, the cup is disposed on a punch mounted on an elongated ram. The ram is structured to reciprocate and pass the cup through the circular dies which (re)draw and iron the cup. That is, on each forward stroke of the ram, a cup is passed through the circular dies which further form the cup into a can body. On the return stroke, the now elongated can body is removed from the ram and a new cup is disposed thereon. Following additional finishing operations, e.g. trimming, washing, printing, etc., the can body is sent to a filler which fills the can with product. A top is then coupled to, and sealed against, the can body, thereby completing the can.

More specifically, the die pack in the bodymaker has multiple, spaced dies, each die having a substantially circular opening. Each die opening is slightly smaller than the next adjacent upstream die. Thus, when the punch draws the cup through the first die, the redraw die, the aluminum cup is deformed over the substantially cylindrical punch. Because the openings in the subsequent dies in the die pack have a smaller inner diameter, i.e. a smaller opening, the aluminum cup is thinned as the ram moves the aluminum through the rest of the die pack. The space between the ram and the redraw die is typically less than about 0.010 inch and less than about 0.004 inch in the last ironing die. After the cup has moved through the last die, the cup bottom and sidewall have the desired thickness; the only other deformation required is to shape the bottom of the cup into an inwardly extending dome.

That is, the distal end of the punch is concave. At the maximum extension of the ram is a "domer." The domer has a generally convex dome and a shaped perimeter. As the ram reaches its maximum extension, the bottom of the can body engages the domer and is deformed into a dome and the bottom perimeter of the can body is shaped as desired; typically angled inwardly so as to increase the strength of the can body and to allow for the resulting cans to be stacked. As the ram withdraws, the can body the is stripped off of the end of the punch by injecting air into the center of the ram. The air comes out of the end of the punch and breaks the can body loose from the punch. Typically, there is also a mechanical stripper, which prevents the can body from staying on the punch it retracts back through the tool pack. The ram is withdrawn through the die pack, a new cup is deposited on the punch and the cycle repeats.

The ram and the die pack are typically oriented generally horizontally. This orientation, however, allows for wear and tear on the ram. That is, the dies in the die pack must be separated so as to allow for the proper deformation of the bank/cup. This means that the ram must extend horizontally through the entire die pack; a distance that may be anywhere from 18 to 30 inches. This is also the stroke length for the bodymaker. This means that the ram is, essentially, a cantilevered arm. As is known, even a very rigid member supported as a cantilever will droop at the distal end. While this droop is generally not a problem for stationary members, the droop is a problem for a reciprocating ram passing through a die with a radial clearance of less than about 0.004 inch. Typically, the domer is statically aligned to the punch, in order to compensate for the droop, however this alignment may not be correct for the dynamics of the ram in the machine. Also, there are other factors that can cause the punch not to run concentrically to the machine center line. Thus, because of the droop and other reasons, the ram may not be concentric with the circular dies, i.e. ram is closer to, or in contact with, the lower portion of the die. Over time, the contact between the ram and the die causes either of both to become damaged. When this happens, the damaged parts must be replaced. Further, because this is a time consuming procedure, and because a typical can forming machine produces over 15,000 cans an hour, having a misaligned ram is a disadvantage. That is, if the ram is misaligned, it is unlikely that any cans will be made. The ram should be aligned to the centerline of the machine (horizontally and vertically).

The position of the ram is also affected by the position of the domer. That is, the ram is brought into engagement with the domer and, if the domer is not properly aligned, will cause the ram to vibrate or otherwise be misaligned with the die pack. Given the narrow spacing between the punch and the dies, even a slight misalignment or slight vibration, may cause the punch to contact the dies. Generally, the domer is mounted on an adjustable assembly. Prior to using the can forming machine, and as part of regular maintenance, the domer is manually aligned with the ram. That is, the ram is placed at, or near, its maximum extension and the domer is aligned with the punch. This method, however, does not solve the problem of abnormal wear on the punch due to contact with the dies. That is, the position of the ram/punch at rest may not be the same as the position of the ram/punch in motion. Thus, a stated problem with the known systems and methods for aligning a punch with a die assembly is that the known systems and methods do not detect the position of the punch in motion.

SUMMARY OF THE INVENTION

The disclosed and claimed device provides for a system that determines the position of a punch as it retracts into a tool pack on a reciprocating ram and allows for the domer to be repositioned automatically. The system includes a punch position sensor assembly, a control system, and a domer positioning assembly. The punch position sensor assembly is positioned about the ram, preferably at the domer side of the last die. At this location, the punch position sensor assembly can determine the position of the punch as it enters the tool pack during the return stroke. The control system receives data from the punch position sensor assembly and, if the punch is not substantially, concentrically aligned with the tool pack on the return stroke, sends a signal to the domer positioning assembly to reposition the domer. This process may be repeated until the punch travels along a path substantially aligned with the tool pack on the return stroke.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As used herein, a "target position" is a selected position for the domer body center relative to the punch. The position is selected so as to cause the punch to be concentric with the tool pack upon the return stroke. This position may, or may not, be aligned with the axis of the ram or the axis of the tool pack.

As used herein, "dynamically positioning" means positioning a domer relative to the punch based on measurements acquired when the punch is in motion. This would include adjusting the domer while the punch is in motion as well as when the punch is motionless, so long as the measurements are acquired when the punch is in motion.

As used herein, "actively positioning" means positioning a domer relative to the punch when the punch is in motion.

As used herein, "coupled" means a link between two or more elements, whether direct or indirect, so long as a link occurs. An object resting on another object held in place only by gravity is not "coupled" to the lower object unless the upper object is otherwise maintained substantially in place. That is, for example, a book on a table is not coupled thereto, but a book glued to a table is coupled thereto.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

As used herein, "associated" means that the identified components are related to each other, contact each other, and/or interact with each other. For example, an automobile has four tires and four hubs, each hub is "associated" with a specific tire.

As used herein, "engage," when used in reference to gears or other components having teeth, means that the teeth of the gears interface with each other and the rotation of one gear causes the other gear to rotate as well.

Figure 1:
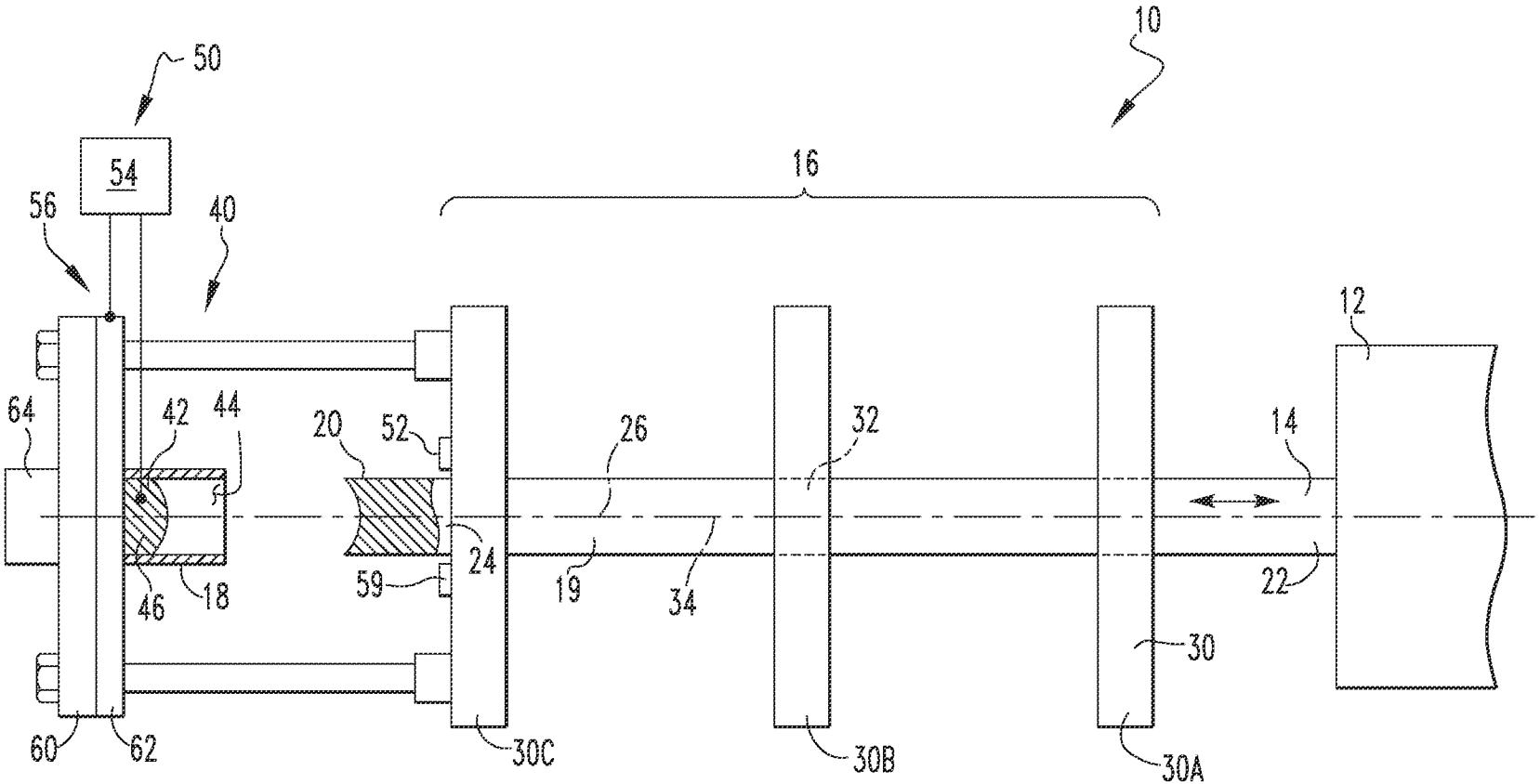
FIG. 1 is a schematic cross-sectional view of a can forming machine.

As shown schematically if FIG. 1, a body maker, or can forming machine, 10 includes an operating mechanism 12 structured to provide a cyclical and/or reciprocating motion, a ram 14, a die assembly 16, and a domer assembly 18. The ram 14 has an elongated, substantially circular body 19 with a proximal end 22, a distal end 24, and a longitudinal axis 26. A punch 20 is disposed at, or over, the ram body distal end 24. The punch 20 is a generally cylindrical body with a concave distal end which may be shaped to correspond to the domer assembly cavity 44, discussed below. The ram body proximal end 22 is coupled to the operating mechanism 12. The operating mechanism 12 provides a reciprocal motion to the ram body 19 causing the ram body 19, and therefore the punch 20, to move back and forth along its longitudinal axis 26. That is, the punch 20 is structured to reciprocate between a retracted position and an extended position, the punch 20 extending and moving generally horizontally through the die assembly 16.

The die assembly 16 includes at least one (three as shown) die(s) 30 (each) having an opening 32 therein. The opening 32 in the first die 30A (the die 30 closest to the operating mechanism 12) is slightly larger than the opening 32 in the second (middle, as shown) die 30B. The opening 32 in the second die 30B is slightly larger than the opening 32 in the third (farthest from the operating mechanism 12) die 30C. That is, the opening 32 in the first die 30A has a radius that is about 0.010 inch larger than the radius of the punch 20, the opening 32 in the second die 30B has a radius that is about 0.007 inch larger than the radius of the punch 20, and opening 32 in the third die 30C has a radius that is about 0.004 inch larger than the radius of the punch 20. The die assembly openings 32 are disposed along a common axis 34. The die assembly axis 34 is generally aligned with the ram body longitudinal axis 26.

In this configuration, the can forming machine 10 is structured to transform a cup into a can body, which may have a top added, forming a can. A cup is disposed over the punch 20, typically when the punch 20 is in the retracted position. When the punch 20 pushes the aluminum disk through the die assembly 16, the cup thinned and stretched to a desired length and wall thickness. The elongated cup is a can body.

The domer assembly 18 is disposed at the end of the ram body 19 stroke. The domer assembly 18 includes the domer die 40 and a movable mounting assembly 62 (discussed below). The domer die 40 is a body 42 with a cavity 44 defining a dome 46. The domer body cavity 44 may include other features structured to shape the bottom of the cup. The center of the dome 46 is substantially aligned with the ram body longitudinal axis 26. In this configuration, when the ram body 19 is at its maximum extension, the cup bottom, that portion of the cup extending over the punch 20, is shaped by the punch 20 entering the domer body cavity 44. That is, the cup bottom becomes an upwardly extending dome 46. After the dome 46 is formed, the ram body 19 begins the rearward portion of the stroke. A can stripper (not shown) is disposed on the outer surface of the third die 30C. The can stripper removes the can body from the punch 20. Thus, the punch 20 travels rearwardly with no cup or other material between the punch 20 and the dies 30A, 30B, 30C.

In this configuration it is possible for the punch 20 to contact the dies 30A, 30B, 30C resulting in damage to the punch 20 and/or the dies 30A, 30B, 30C. To prevent or reduce this damage, it is advantageous to have the ram body longitudinal axis 26 and the die axis 34 substantially aligned. That is, the punch 20 should not be vibrating or drooping. The punch 20, disposed on the ram body distal end 24, is prone to drooping as it is a cantilever body. Further, if the dome 46 is misaligned with the ram body longitudinal axis 26, the punch 20 may be pushed out of alignment with the die axis 34 upon entering the domer cavity 44 and then rapidly returned, i.e.

snapped, into alignment when leaving the domer cavity 44. This action may cause the punch 20 to vibrate. While both the amount of droop and the misalignment caused by vibration are small, the tolerances between the punch 20 and the die openings 32 are sufficiently small so that any droop or vibration may cause contact between the punch 20 and the die openings 32.

Figure 2:
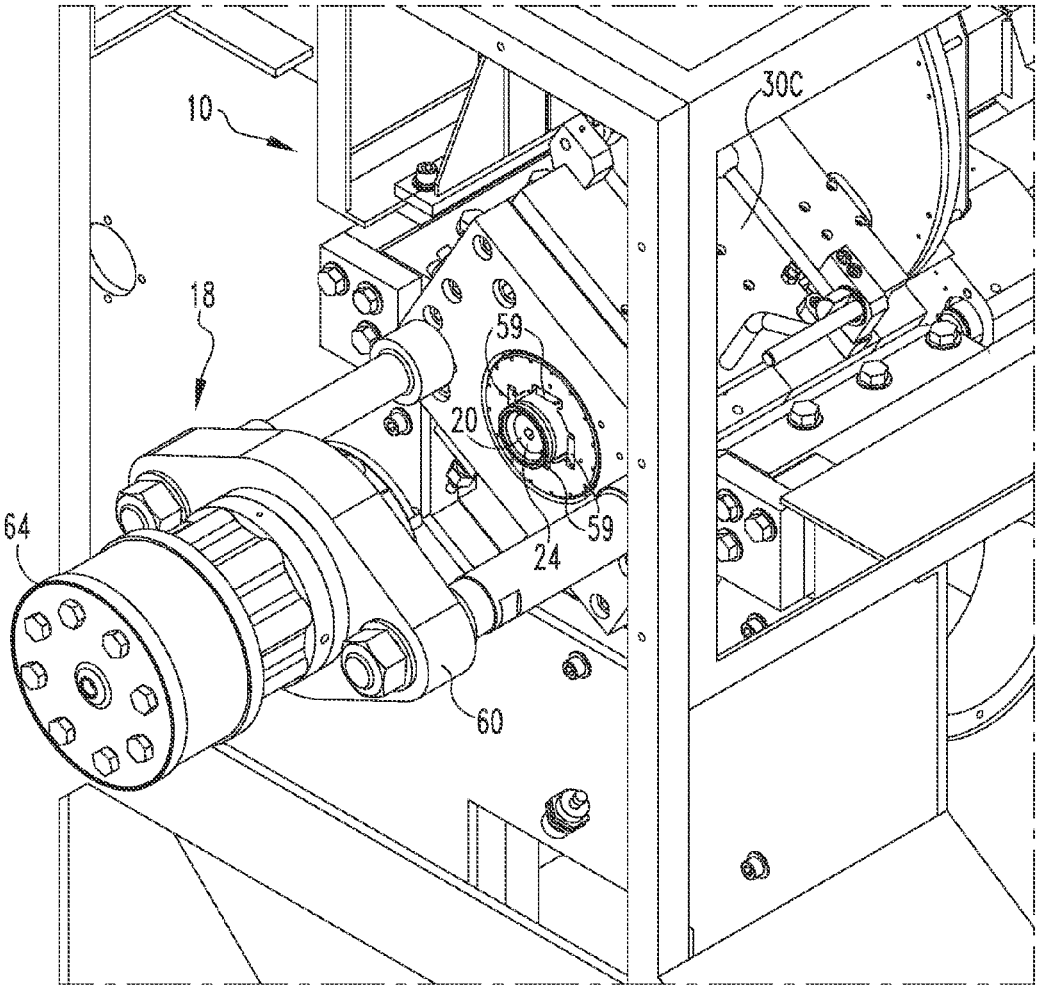
FIG. 2 is an isometric detailed end view of a can forming machine.

A domer positioning system 50 is structured to reduce the amount of contact between the punch 20 and the die assembly 16. The domer positioning system 50 includes a punch position sensor assembly 52, a control system 54, and a domer positioning assembly 56. The punch position sensor assembly 52 is structured to determine the moving configuration of the punch 20. That is, a moving ram body 19 and the punch 20 disposed thereon may not droop in the same manner as a stationary ram body 19, and/or, the moving ram body 19 may be vibrating. Thus, the punch position sensor assembly 52 is structured to determine the moving configuration of the punch 20 as it enters the die assembly 16 during the return stroke of the ram body 19. Thus, the punch position sensor assembly 52 is preferably disposed at the third die 30C and, more preferably, includes a plurality of sensors 59, which are preferably inductive proximity sensors structured to provide an output signal proportional to the distance of the punch 20 from the sensor 59, disposed about the outer side of the opening 32 in the third die 30C, as shown in FIG. 2. The sensors 59 determine the position of the punch 20, and more preferably the ram body distal end 24, during the return stroke of the punch 20. The punch position sensor assembly 52 is structured to convert the measurements into electronic data provided as a "punch moving configuration signal." That is, the punch moving configuration signal includes data representing the punch 20 moving configuration.

Figure 3:
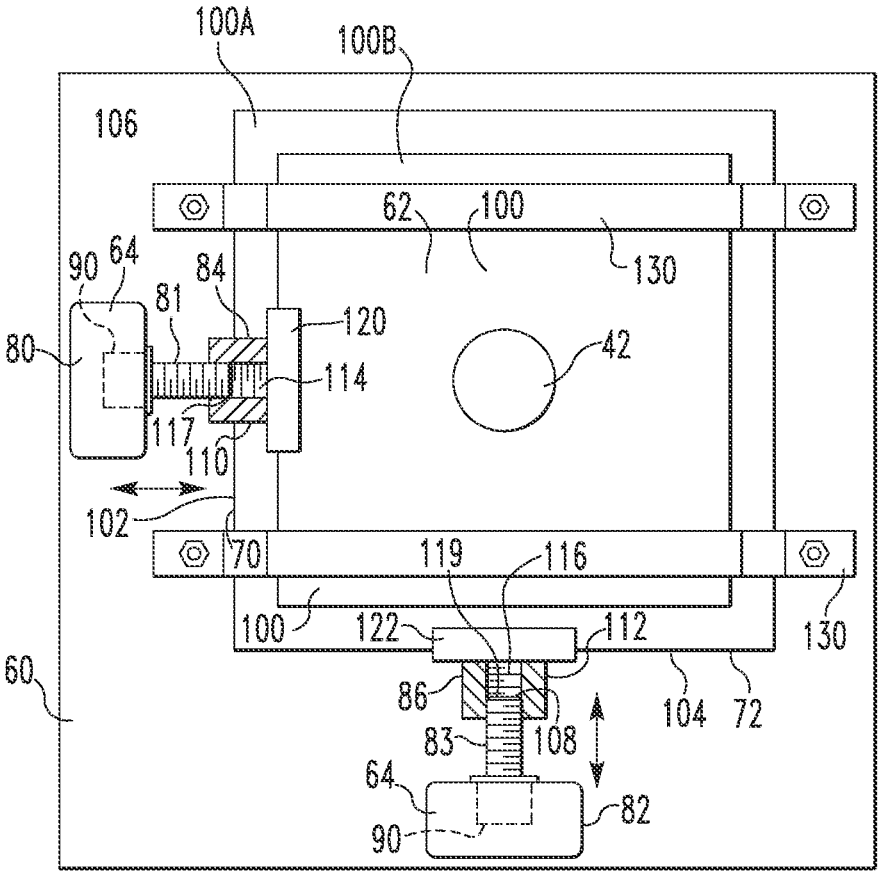
FIG. 3 is a schematic front view of one embodiment of the domer positioning system.
Figure 4:
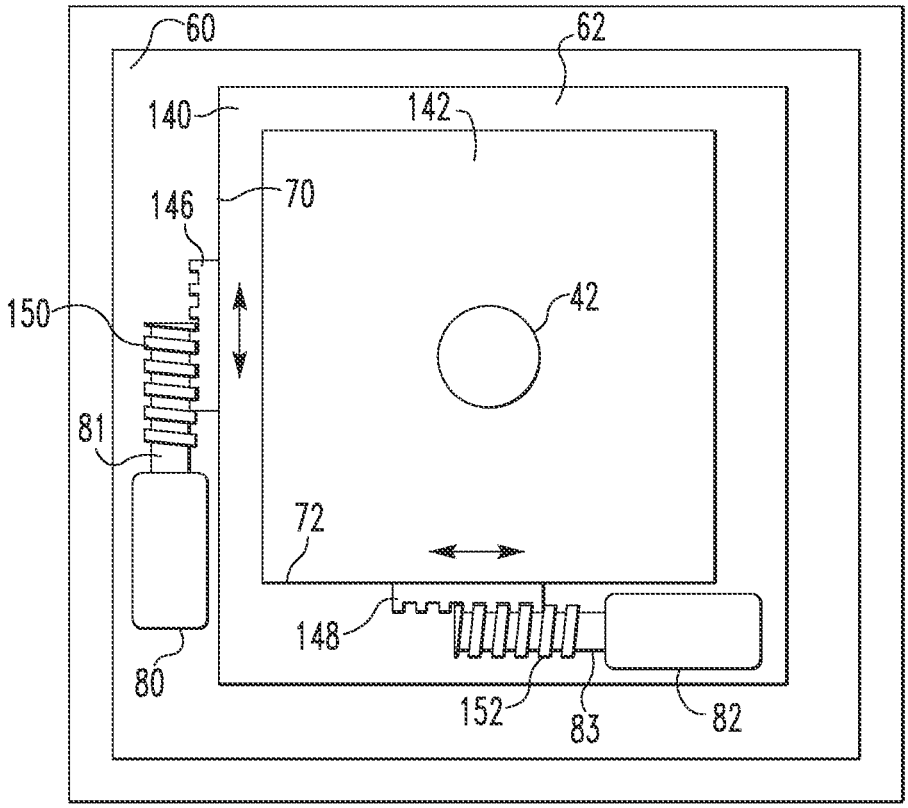
FIG. 4 is a schematic front view of another embodiment of the domer positioning system.
Figure 5:
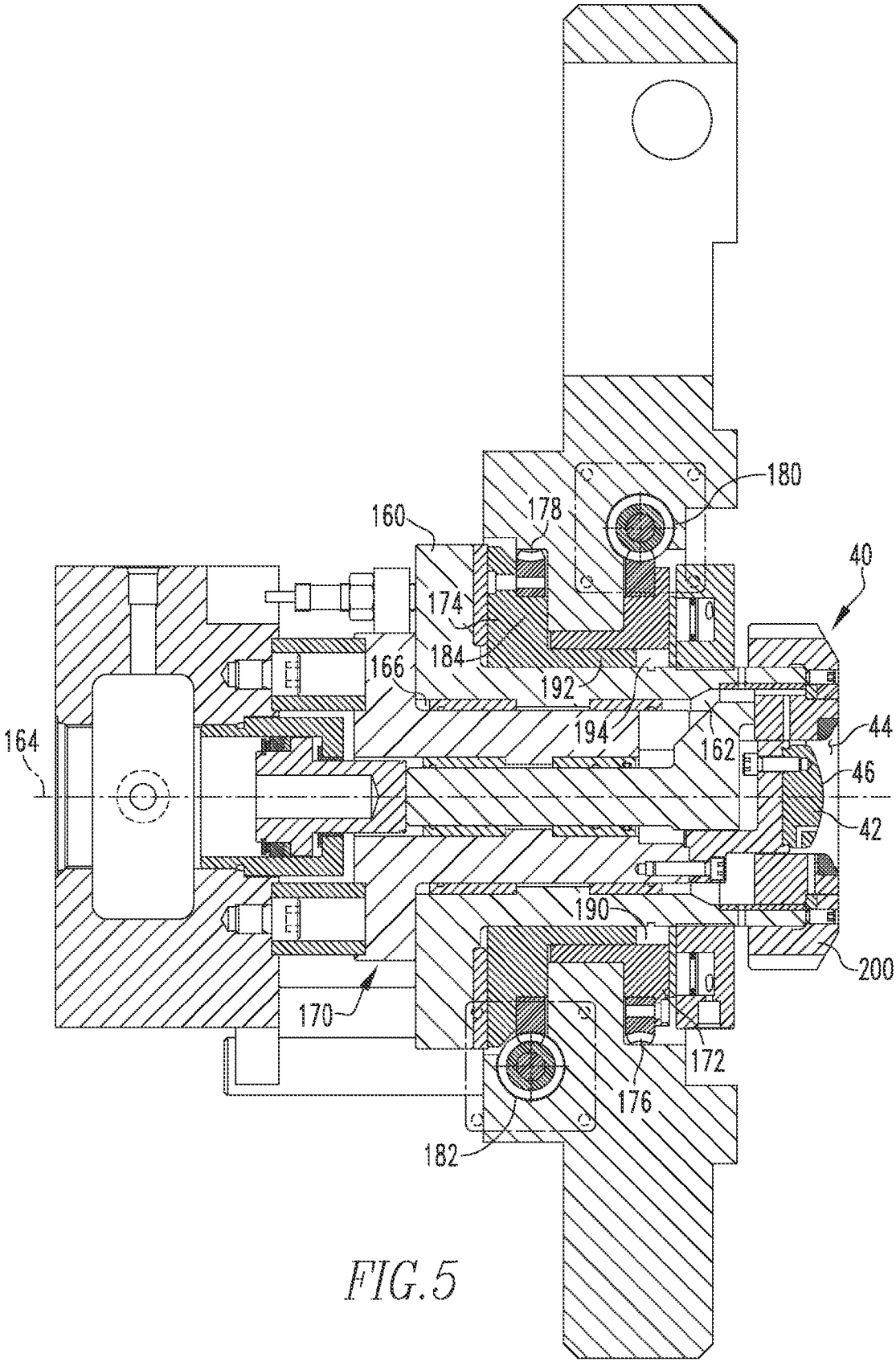
FIG. 5 is a cross-sectional side view of another embodiment of the domer positioning system.

The control system 54, shown schematically in FIGS. 1 and 3, utilizes a programmable logic circuit (PLC) and a stored algorithm to analyze the punch moving configuration signal and to provide a domer target position signal. That is, the control system 54, via its programming, is structured to relate the position of the moving punch 20 to a specific location of the domer body 42. Based upon the location of the punch 20 during a return stroke, the control system 54 can determine the location of the domer body 42. The control system 54 is further structured to determine a target position for the domer body 42 so as to place the punch 20 at a specific location during the return stroke. The specific location for the punch 20, preferably, is entering the die assembly 16 in a substantially concentric relationship, i.e. having the ram body longitudinal axis 26 and the die assembly axis 34 substantially aligned. Thus, the control system 54 is structured to determine the present location of the domer body 42 based on the punch moving configuration signal and further structured to calculate a target position for the domer body 42 so as to place the punch 20 in a substantially concentric relationship to the die openings 32. The data representing the target position for the domer body 42 is incorporated into a "domer target position signal."

The domer target position signal is provided to the domer positioning assembly 56. The domer positioning assembly 56 is structured to support the domer body 42. The domer positioning assembly 56 is further structured to translate, i.e. move while maintaining the orientation of, the domer body 42 in a plane extending substantially perpendicular to the ram body longitudinal axis 26. The domer positioning assembly 56 includes a fixed mounting 60, a movable mounting assembly 62 and a drive assembly 64. The fixed mounting 60 is structured to maintain its position relative to the die assembly 16 and, as shown, may be coupled thereto. The movable mounting assembly 62 is structured to support the domer body 42 with the cavity 44 facing the punch 20. Further, the movable mounting assembly 62 includes a mount assembly having a first surface 70 and a second surface 72, the first and second surfaces 70,72 being engagement surfaces. That is, the first and second surfaces 70, 72 are structured to be engaged by the drive assembly 64. As discussed below, the engagement surface may be a coupling or, as in the preferred embodiment, the engagement surface may be a toothed surface. The drive assembly 64 includes a first motor 80, a second motor 82, a first engagement device 84, and a second engagement device 86. Each motor 80, 82 has a rotating output shaft 81, 83, and each engagement device 84, 86 is coupled to an associated motor output shaft 81, 83, and structured to engage an associated engagement surface 70, 72. The drive assembly 64 may include a PLC, or similar device, structured to control the motors 80, 82. Alternately, the motors 80, 82 may be structured to receive commands, via a signal, directly from the control system 54.

The control system 54 further includes a position tracking assembly 90. The position tracking assembly 90 is structured to track the position of the domer body 42 as the movable mounting assembly 62 moves. The tracking may occur optically, by position sensors (not shown) disposed between the fixed mounting 60 and the movable mounting assembly 62, or by sensors 59 that track the position of the motor output shaft 81, 83, or any other known device and associated method. The position tracking assembly 90 provides a domer position signal wherein the domer position signal includes data representing the current position of the domer body 42. The domer position signal is communicated to the control system 54. The control system 54 is further structured to compare the domer target position signal and the domer position signal, that is the control system 54 is structured to compare the actual position of the domer body 42 to the target position for the domer body 42, and to continue actuating the drive assembly 64 until the domer body 42 is in the target position. That is, the control system 54 is structured to receive the domer position signal and to arrest the drive assembly 64 when said domer body 42 is disposed in the target position.

In one embodiment, the domer positioning assembly 56 is a plate extending in a plane generally perpendicular to the ram longitudinal axis 26 and structured to translate in its own plane. That is, the domer positioning assembly 56 includes one or more planar members (two as shown) 100A, 100B having at least two surfaces 102, 104, the planar member at least two surfaces 102, 104 being the first and second surfaces 70, 72. Preferably there are two planar members 100 movably coupled to each other. For example, the inner planar member 100A closest to the fixed mounting 60 may include a substantially vertical groove (not shown) and the outer planar member 100B may have a tongue (not shown) corresponding to the groove.

The planar member at least two surfaces 102, 104 are preferably two perpendicular surfaces, such as, but not limited to, two side surfaces on a rectangular plate. The first and second motor drive output shafts 81, 83 each have a threaded distal end 106, 108. Each of the first and second engagement devices 84, 86 are jack screws 110, 112 each having a threaded bore 114, 115 structured to engage one of the first or second drive shafts 81, 83 a distal end 106, 108 and structured to be coupled to one of the first or second surfaces 102, 104. That is, the jack screws 110, 112 may have a bracket 120, 122 or similar device structured to be coupled to the planar member 100. The first jack screw 110 is threadably coupled to the first motor drive shaft 81 by its threaded bore 114. The second jack screw 112 is threadably coupled to the second motor drive shaft 83 by its threaded bore 116. The first jack screw bracket 120 coupled to the planar member first surface 102. The second jack screw bracket 122 is coupled to the planar member second surface 104. In this configuration, actuation of first motor 80 causes the first jack screw 110 to extend or retract relative to the first drive shaft 81 thereby causing the inner planar member 100A to move along a first axis. Further, actuation of the second motor 82 causes the second jack screw 112 to extend or retract relative to the second drive shaft 83 thereby causing the outer planar member 100B to move along a second axis. That is, the axes of the two motor drive shafts 81, 83 are preferably not parallel and are, more preferably, generally perpendicular to each other while disposed in a plane substantially aligned with, or parallel to, the plane defined by the planar members 100A, 100B. The planar members 100A, 100B may be disposed behind a frame 130, or similar orienting device, structured to maintain each planar member 100A, 100B extending in a plane generally perpendicular to the ram longitudinal axis 26.

In another embodiment, domer positioning assembly 56 includes two plates, a first plate structured to travel along one axis, e.g. vertical, and a second plate structured to travel along the other axis, e.g. horizontal. While these plates may be moved using a jack screw as described above, greater control may be provided with a worm gear as described below. In this embodiment, the domer positioning assembly 56 includes a first planar member 140 and a second planar member 142. The first surface 70 being on the first planar member 140 and the second surface 72 being on the second planar member 142. The first and second surfaces 70, 72 are, preferably, substantially straight and perpendicular to each other. Each movable mounting assembly planar member engagement surface, i.e. first and second surfaces 70, 72, are preferably a toothed rack 146, 148.

The first planar member 140 is movably coupled to the fixed mounting 60 and is structured to translate over a first axis. For example, the fixed mounting 60 may include a substantially vertical groove (not shown) and the first planar member 140 may have a tongue (not shown) corresponding to the groove. Similarly, the second planar member 142 is movably coupled to the first planar member 140 and is structured to translate over a second axis. Preferably, the second planar member 142 travel axis is substantially perpendicular to the first planar member 140 travel axis and is substantially parallel to the plane defined by said first planar member 140. The first motor 80 is mounted on the fixed mounting 60 and the second motor 82 is mounted on the first planar member 140. The drive assembly first engagement device 84 is a worm gear 150 positioned to engage the first planar member toothed rack 146. The drive assembly second engagement device 86 is a worm gear 152 positioned to engage the second planar member toothed rack 148. The second planar member 142 is structured to support the domer body 42 with the cavity 44 facing the punch 20.

Because the ram body 19 is a cantilever body, it tends to flex radially about its supported end. That is, the displacement of the ram body distal end 24 typically occurs anywhere over a circular pattern. As such, the preferred embodiment of the domer positioning assembly 56 is structured to move the domer body 42 over a circular area. The domer positioning assembly 56 includes a housing 160, which may be in the fixed mounting 60, defining a rotational space 162 having an axis of rotation 164, and the movable mounting assembly 62 includes a mount assembly 170 having a first substantially circular member 172 and a second substantially circular member 174. The rotational space 162 may be defined by rollers (not shown), or a similar device, in a rectangular space, but is, preferably, defined by a cylindrical cavity 166 in the mount assembly 170. The first circular member 172 is rotatably disposed in the rotational space 162 with the first circular member 172 center disposed substantially on the housing rotational space axis 164. The first circular member 172 is structured to rotate about the rotational space axis of rotation 164. The second circular member 174 is rotatably coupled to the first circular member 172, but the second circular member 174 center is radially offset from the first circular member 172 center. As before, the drive assembly 64 has a first motor 80 and a second motor 82, each motor 80, 82 having a rotating output shaft 81, 83, each motor output shaft 81, 83 is structured to engage, and rotate, one of the first or second circular members 172, 174.

More specifically, the first circular member 172 includes the first engagement surface 70 and the second circular member includes the second engagement surface 72. The first and second engagement surfaces 70, 72 are, preferably, toothed racks 176,178 disposed near, or preferably on, the radial surfaces of the first and second circular members 172, 174. As before, each drive assembly motor 80, 82 include a first engagement device 84 and a second engagement device 86, respectively. The engagement devices 84, 86 in this embodiment are a first and second worm gear 180,182 each disposed on an associated motor output shaft 81, 83 and structured to engage the associated engagement surface 70, 72. That is, the first worm gear 180 is structured to engage the first circular member toothed rack 176 and the second worm gear 182 is structured to engage the second circular member toothed rack 178.

If the domer body 42 was mounted on a single circular member 172, 174, and not disposed on the axis of rotation, the domer body 42 could be moved in a circle about the axis of rotation. By providing two circular members 172, 174 moving relative to each other (that is, having offset axes), and by having the center of the domer body 42, i.e. the center of the dome 46 offset from the center of the second circular member 174, the domer body 42 may be positioned anywhere within a circle defined by the maximum radii of the two circular members 172, 174. This does, however, create a problem in that the center of the second circular member 174 does move in a circle as the first circular member 172 rotates. This, in turn, means that the perimeter of the second circular member 174, where the second circular member toothed rack 178 is located, also moves. This means that the second worm gear 182 must accommodate the motion of the second circular member toothed rack 178 about the center of the first circular member 172. One solution would be to mount the second motor 82 on the first circular member 172, thereby keeping the second worm gear 182 and the second circular member toothed rack 178 in a constant relationship.

In the preferred embodiment, however, the first and second motors 80, 82 are mounted on the fixed mounting 60 and the two circular members 172, 174 have about the same diameter. The second worm gear 182 maintains engagement with the second circular member toothed rack 178 by having an extended tooth. That is, as noted above, the gap between the punch 20 and the die openings 32 is very small. Similarly, the amount that the domer body 42 must be adjusted is very small. This means that the amount of offset between the first and second member 172, 174 axes of rotation is also very small. When a worm gear rack radius is substantially larger than the worm gear radius, the lateral sides of the worm gear still engage the sides of the rack teeth even as the rack moves slightly away from the worm gear. Thus, this configuration still allows for precise control of the position of the two circular members 172, 174 even when the second circular member 174 moves relative to the second worm gear 182.

In this configuration, motion from the first motor 80 is transferred to the first circular member 172 via the engagement of the first engagement device 84 with the first engagement surface 70, and, motion from the second motor 82 is transferred to the second circular member 174 via the engagement of the second engagement device 86 with the second engagement surface 72.

While the second circular member 174 may be mounted on an axle (not shown) extending from the first circular member 172, in the preferred embodiment, the first circular member 172 has a circular opening 190 therein. The center of the first circular member opening 190 is offset from the center of the first circular member 172. The second circular member 174 has a cylindrical portion 192 and a flange 184 at one end. The second circular cylindrical portion 192 is sized to fit snugly, but rotatably, within the first circular member opening 190. The second circular member flange 184, preferably, has a radius substantially the same as the radius of the first circular member 172. In this configuration, the second circular member cylindrical portion 192 may be disposed in the first circular member opening 190, while the second circular member flange 184, which is longitudinally offset from the first circular member 172, may be engaged by a worm gear 182 on a motor 82 coupled to the fixed mounting 60. Further, the second circular member 174 also has an offset, substantially circular opening 194 therein. The domer body 42 is disposed in the second circular member circular opening 194. As discussed and shown below, positioning the two circular members 172, 174 at different orientations allows for the domer body 42 to be placed in the target location.

The offset between the first circular member 172 center and the first circular member circular opening 190 center is between about 0.005 and 0.020 inch, and more preferably about 0.015 inch, and, the offset between said second circular member 174 center and said domer body 42 center is between about 0.005 and 0.020 inch, and more preferably about 0.015 inch. The position of the center of the domer body 42 relative to the first circular member axis of rotation may be expressed in Cartesian coordinates by the equations:

$x_{i,j}$:=$e1\cdot\sin(\alpha_i\cdot\text{deg})+e2\cdot\sin(\beta_j\cdot\text{deg})$ which is the resultant $X$ position of the center of the domer body 42.

$y_{i,j}$:=$e1\cdot\cos(\alpha_i\cdot\text{deg})-e2\cdot\cos(\beta_j\cdot\text{deg})$ which is the resultant $Y$ position of the center of the domer body 42.

wherein:

e1:=first circular member 172 eccentricity, preferably 0.015 in.

e2:=second circular member 174 eccentricity, preferably 0.015 in.

i:=range of angular displacement in degrees (0, 1 . . . 359)

j:=range of angular displacement in degrees (0, 1 . . . 359)

Figure 6A:
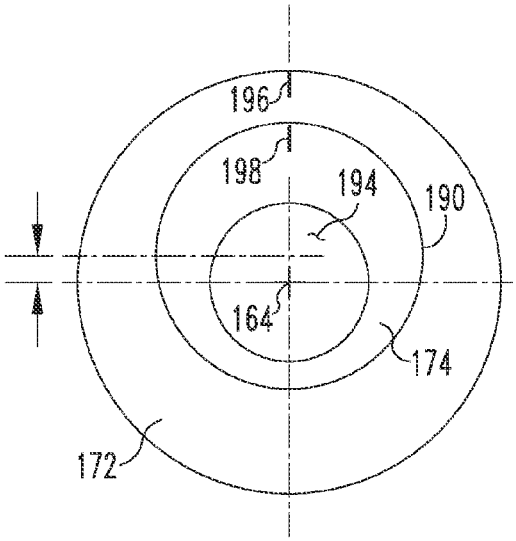
FIGS. 6A-6H are schematics showing different configurations of the domer positioning system shown in FIG. 5.
Figure 6B:
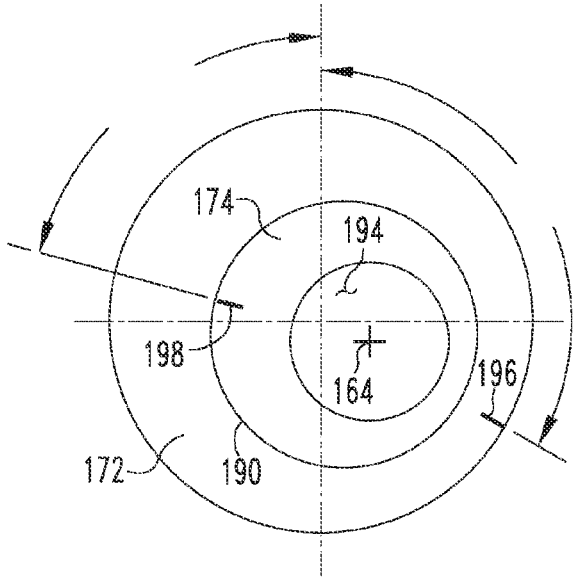
Figure 6C:
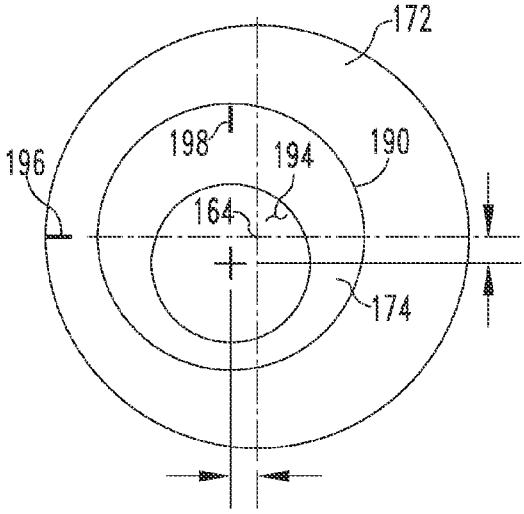
Figure 6D:
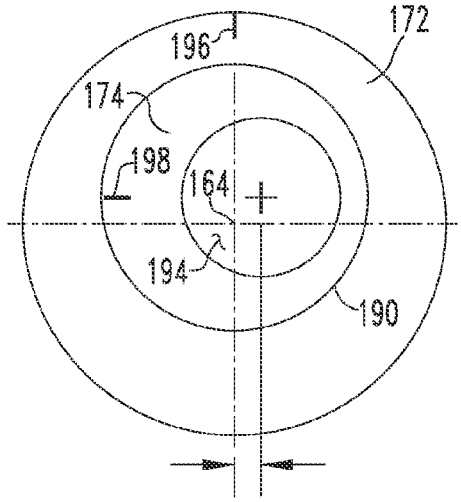
Figure 6E:
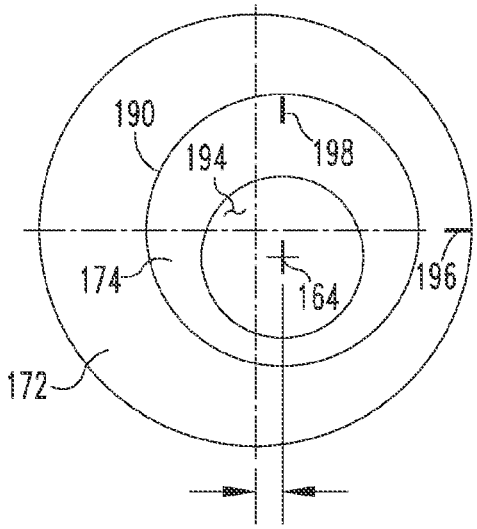
Figure 6F:
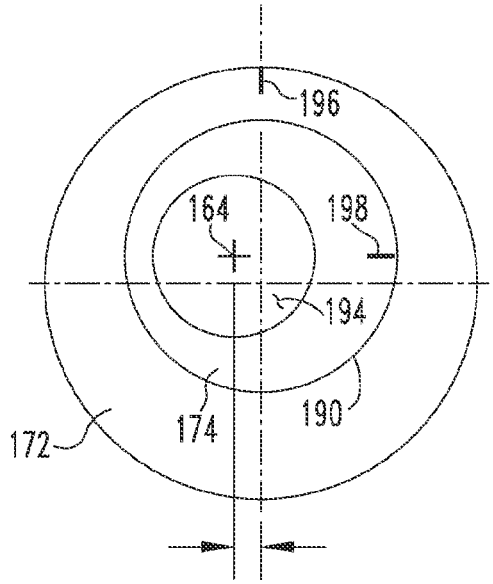
Figure 6G:
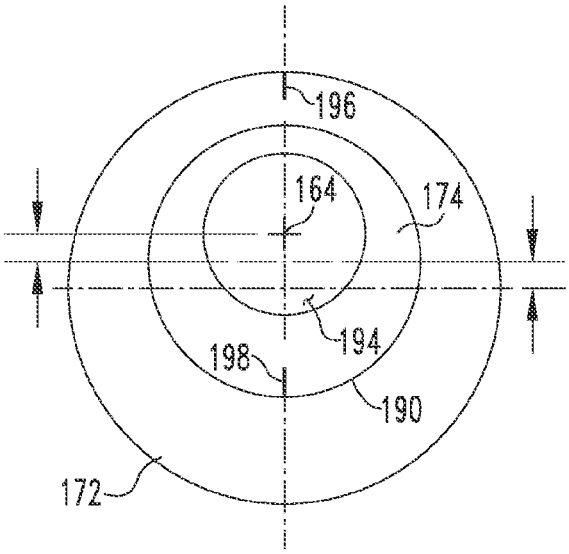
Figure 6H:
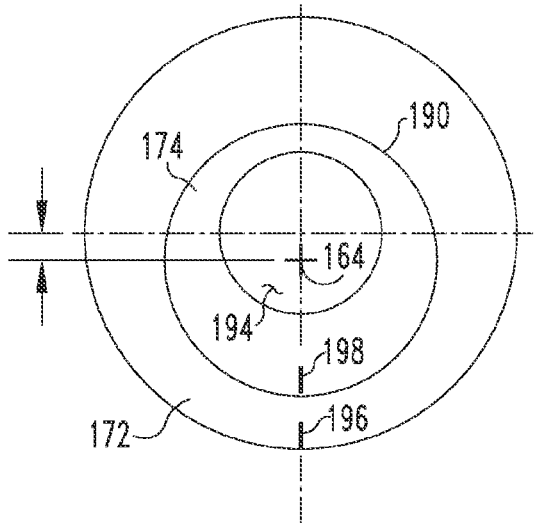

$\alpha_i$:=i first circular member 172 angular displacement $\beta_j$:=j second circular member 174 angular displacement As shown in FIGS. 6A-6H, different orientations for the two circular members 172, 174 are shown as well as the position of the second circular member circular opening 194. For example, the two circular members 172, 174 may each include an indica 196, 198 indication the orientation of each circular member 172, 174. In FIG. 6A, the two circular members 172, 174 are positioned at an orientation identified as "0°" The offset of the center of the second circular member circular opening 194, which is the same as the position of the center of the domer body 42, is offset upwardly from the center of the rotational space axis of rotation 164. In FIG. 6B, and as indicated by the indicia 196, 198, the first circular member 172 has been rotated 120° is one direction and the second circular member 174 has been rotated 75° in the opposite direction. Now, the offset of the center of the second circular member circular opening 194 is downwardly and to the right from the center of the rotational space axis of rotation 164. Other configurations of the two circular members 172, 174 are shown in FIG. 6C-6H as indicated on each Figure.

The domer positioning assembly 56 may further include a clamping device 200. The clamping device 200 is structured to arrest the motion between the movable mounting assembly 62 and the fixed mounting 60. Typically, the domer positioning system 50 is utilized prior to running the can forming machine 10 so as to calibrate the position of the punch 20 relative to the die openings 32. This may be performed with or without a cup disposed on the punch 20. Typically, this would be performed by running a single cycle of the operating mechanism 12 to determine the position of the moving punch 20 relative to the die openings 32, then adjusting the position of the domer body 42, and running another single cycle of the operating mechanism 12. This type of positioning the domer body 42 is identified as dynamically positioning the domer body 42 as the punch 20 is in motion during the process. It is, however, possible to have the domer positioning system 50 in constant operation, that is, adjusting the position of the domer body 42 while the operating mechanism 12 is in constant use and the punch 20 is constantly moving. This type of positioning is identified as actively positioning the domer body 42.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A domer positioning system for positioning a domer relative to a punch in a can forming machine, said punch disposed at a distal end of a ram, said ram having a body with a longitudinal axis, said domer positioning system comprising:

a control system structured to provide a domer target position signal;

said domer target position signal including data representing a target position for said domer; and a domer positioning assembly structured to support said domer, to receive said domer target position signal and to translate said domer in a plane extending substantially perpendicular to said ram body longitudinal axis to be in said target position.

2. The domer positioning system of claim 1 wherein:

said domer positioning assembly includes a movable mounting assembly and a drive assembly;

said movable mounting assembly structured to support said domer; and said drive assembly structured to move said movable mounting assembly.

3. The domer positioning system of claim 2 wherein:

said movable mounting assembly includes a mount assembly having a first surface and a second surface, said first and second surfaces being engagement surfaces;

said control system includes a position tracking assembly, said position tracking assembly structured to track the position of said domer as said movable mounting assembly moves and to provide a domer position signal, said domer position signal including data representing the position of said domer; and said drive assembly structured to receive said domer position signal and to arrest said drive assembly when said domer is disposed in said target position.

4. The domer positioning system of claim 3 wherein:

said mount assembly includes a planar member having at least two surfaces, said planar member at least two surfaces being said first and second surfaces;

said drive assembly including a first motor, a second motor, a first engagement device, and a second engagement device, each said motor having a rotating output shaft, each said engagement device coupled to an associated motor output shaft and structured to engage an associated engagement surface;

said first motor drive shaft having a threaded distal end;

said second motor drive shaft having a threaded distal end;

each of said first and second engagement devices being a jack screw having a threaded bore structured to engage one of said first or second drive shafts and a distal end structured to be coupled to one of said first or second surfaces;

said first jack screw being threadably coupled to said first motor drive shaft by said threaded bore;

said second jack screw being threadably coupled to said second motor drive shaft by said threaded bore;

said first jack screw distal end coupled to said planar member first surface; and said second jack screw distal end coupled to said planar member second surface.

5. The domer positioning system of claim 3 wherein:

said mount assembly includes a first planar member and a second planar member;

said first surface being on said first planar member;

said second surface being on said second planar member;

said first and second surface being substantially straight and perpendicular to each other;

said first planar member movably coupled to said fixed mounting and structured to translate over a first axis; and said second planar member movably coupled to said first planar member and structured to translate over a second axis, said second planar member second axis being substantially perpendicular to said first planar member first axis and substantially parallel to the plane defined by said first planar member.

6. The domer positioning system of claim 2 wherein:

said domer positioning assembly includes a fixed mounting;

said fixed mounting includes a housing defining a rotational space having an axis of rotation;

said movable mounting assembly includes a mount assembly having a first substantially circular member and a second substantially circular member;

said first circular member rotatably disposed in said rotational space with the first circular member center disposed substantially on said rotational space axis, said first circular member structured to rotate about said rotational space axis of rotation;

said second circular member rotatably coupled to said first circular member, said second circular member center being radially offset from said first circular member center; and said drive assembly having a first motor and a second motor, each said motor having a rotating output shaft, each said motor output shaft and structured to engage, and rotate, one of said first or second circular members.

7. The domer positioning system of claim 6 wherein:

said a control system includes a position tracking assembly, said position tracking assembly structured to track the position of said domer as said mount assembly moves and to provide a domer position signal, said domer position signal including data representing the position of said domer; and said control system structured to receive said domer position signal and to arrest said drive assembly when said domer is disposed in said target position.

8. The domer positioning system of claim 6 wherein:

said first circular member having a first engagement surface;

said second circular member having a second engagement surface;

said drive assembly including a first engagement device, and a second engagement device, each said engagement device disposed on an associated motor output shaft and structured to engage an associated engagement surface;

whereby motion from said first motor is transferred to said first circular member via the engagement of said first engagement device with said first engagement surface; and whereby motion from said second motor is transferred to said second circular member via the engagement of said second engagement device with said second engagement surface.

9. The domer positioning system of claim 8 wherein:

said first engagement surface is a radial surface on said first circular member, said first engagement surface being a toothed rack;

said second engagement surface is a radial surface on said second circular member, said second engagement surface being a toothed rack;

said first engagement device being a worm gear; and said second engagement device being a worm gear.

10. The domer positioning system of claim 6 wherein:

said first circular member includes a substantially circular opening, the center of said first circular member opening being offset from the center of said first circular member;

said second circular member being sized to fit rotatably within said first circular member opening;

wherein said second circular member is disposed rotatably within said first circular member opening.

11. The domer positioning system of claim 10 wherein:

the offset between said first circular member center and said first circular member opening center is between about 0.005 inch and 0.020 inch; and the offset between said second circular member center and said domer center is between about 0.005 inch and 0.020 inch.

12. The domer positioning system of claim 11 wherein:

the offset between said first circular member center and said first circular member opening center is about 0.015 inch; and the offset between said second circular member center and said domer center is about 0.015 inch.

13. A can forming machine comprising:

a ram body, said ram body being an elongated body with a longitudinal axis and a distal end;

an operating mechanism structured to reciprocally move said ram body between a first retracted position and a second extended position;

a punch disposed at said ram body distal end;

a domer, said domer defining a dome;

a domer positioning system for positioning said domer relative to said punch, said domer positioning system including a control system and a domer positioning assembly;

said control system structured to provide a domer target position signal;

said domer target position signal including data representing a target position for said domer; and said domer positioning assembly structured to support said domer, to receive said domer target position signal and to translate said domer in a plane extending substantially perpendicular to said ram body longitudinal axis to be in said target position.

14. The can forming machine of claim 13 wherein:

said domer positioning assembly includes a movable mounting assembly and a drive assembly;

said movable mounting assembly structured to support said domer; and said drive assembly structured to move said movable mounting assembly.

15. The can forming machine of claim 14 wherein:

said movable mounting assembly includes a mount assembly having a first surface and a second surface, said first and second surfaces being engagement surfaces;

said control system includes a position tracking assembly, said position tracking assembly structured to track the position of said domer as said movable mounting assembly moves and to provide a domer position signal, said domer position signal including data representing the position of said domer; and said drive assembly structured to receive said domer position signal and to arrest said drive assembly when said domer is disposed in said target position.

16. The can forming machine of claim 15 wherein:

said mount assembly includes a planar member having at least two surfaces, said planar member at least two surfaces being said first and second surfaces;

said drive assembly including a first motor, a second motor, a first engagement device, and a second engagement device, each said motor having a rotating output shaft, each said engagement device coupled to an associated motor output shaft and structured to engage an associated engagement surface;

said first motor drive shaft having a threaded distal end;

said second motor drive shaft having a threaded distal end;

each of said first and second engagement devices being a jack screw having a threaded bore structured to engage one of said first or second drive shafts and a distal end structured to be coupled to one of said first or second surfaces;

said first jack screw being threadably coupled to said first motor drive shaft by said threaded bore;

said second jack screw being threadably coupled to said second motor drive shaft by said threaded bore;

said first jack screw distal end coupled to said planar member first surface; and said second jack screw distal end coupled to said planar member second surface.

17. The can forming machine of claim 15 wherein:

said mount assembly includes a first planar member and a second planar member;

said first surface being on said first planar member;

said second surface being on said second planar member;

said first and second surface being substantially straight and perpendicular to each other;

said first planar member movably coupled to said fixed mounting and structured to translate over a first axis; and said second planar member movably coupled to said first planar member and structured to translate over a second axis, said second planar member second axis being substantially perpendicular to said first planar member first axis and substantially parallel to the plane defined by said first planar member.

18. The can forming machine of claim 14 wherein:

said domer positioning assembly includes a fixed mounting;

said fixed mounting includes a housing defining a rotational space having an axis of rotation;

said movable mounting assembly includes a mount assembly having a first substantially circular member and a second substantially circular member;

said first circular member rotatably disposed in said rotational space with the first circular member center disposed substantially on said rotational space axis, said first circular member structured to rotate about said rotational space axis of rotation;

said second circular member rotatably coupled to said first circular member, said second circular member center being radially offset from said first circular member center; and said drive assembly having a first motor and a second motor, each said motor having a rotating output shaft, each said motor output shaft and structured to engage, and rotate, one of said first or second circular members.

19. The can forming machine of claim 18 wherein:

said control system includes a position tracking assembly, said position tracking assembly structured to track the position of said domer as said mount assembly moves and to provide a domer position signal, said domer position signal including data representing the position of said domer; and said control system structured to receive said domer position signal and to arrest said drive assembly when said domer is disposed in said target position.

20. The can forming machine of claim 18 wherein:

said first circular member having a first engagement surface;

said second circular member having a second engagement surface;

said drive assembly including a first engagement device, and a second engagement device, each said engagement device disposed on an associated motor output shaft and structured to engage an associated engagement surface;

whereby motion from said first motor is transferred to said first circular member via the engagement of said first engagement device with said first engagement surface; and whereby motion from said second motor is transferred to said second circular member via the engagement of said second engagement device with said second engagement surface.

21. The can forming machine of claim 20 wherein:

said first engagement surface is a radial surface on said first circular member, said first engagement surface being a toothed rack;

said second engagement surface is a radial surface on said second circular member, said second engagement surface being a toothed rack;

said first engagement device being a worm gear; and said second engagement device being a worm gear.

22. The can forming machine of claim 18 wherein:

said first circular member includes a substantially circular opening, the center of said first circular member opening being offset from the center of said first circular member;

said second circular member being sized to fit rotatably within said first circular member opening; and wherein said second circular member is disposed rotatably within said first circular member opening.

23. The can forming machine of claim 22 wherein:

the offset between said first circular member center and said first circular member opening center is between about 0.005 inch and 0.020 inch; and the offset between said second circular member center and said domer center is between about 0.005 inch and 0.020 inch.

24. The can forming machine of claim 23 wherein:

the offset between said first circular member center and said first circular member opening center is about 0.015 inch; and the offset between said second circular member center and said domer center is about 0.015 inch.

* * * * *

UNITED STATES PATENT AND TRADEMARK OFFICE

CERTIFICATE OF CORRECTION

PATENT NO. : 8,869,578 B2
APPLICATION NO. : 14/219266
DATED : October 28, 2014
INVENTOR(S) : Karl Scott Fleischer et al.

It is certified that error appears in the above-identified patent and that said Letters Patent is hereby corrected as shown below:

In the specification
Column 1, line 63, “body the is” should read --body is--.
Column 2, line 1, “punch it” should read --punch as it--.
Column 2, line 25, “either of both” should read --either or both--.
Column 7, line 2, “bracket 120 coupled” should read --bracket 120 is coupled--.
Column 9, line 65, ““0°” The” should read --“0°”. The--.
Column 10, line 3, “120° is one” should read --120° in one--.

Signed and Sealed this
Twenty-sixth Day of January, 2016

Michelle K. Lee

Michelle K. Lee
*Director of the United States Patent and Trademark Office*